US005984113A

United States Patent [19]

Roberson

[11] Patent Number: 5,984,113

[45] Date of Patent: Nov. 16, 1999

[54] SHOE STORAGE SYSTEM WITH A COMPACT SHOE POUCH TRANSPORT MECHANISM

[76] Inventor: Bernice Roberson, 2439-22nd Ave. South, St. Petersburg, Fla. 33717-3054

[21] Appl. No.: 08/955,596

[22] Filed: Oct. 22, 1997

[51] Int. Cl.[6] ..... A47F 7/08; A47F 3/08

[52] U.S. Cl. ..... 211/34; 211/1.57; 211/121

[58] Field of Search ..... 211/34, 35, 1.57, 211/121; 312/299, 304

[56] References Cited

U.S. PATENT DOCUMENTS

| | | | |
|---|---|---|---|
| 577,890 | 3/1897 | Tucker | 211/121 |
| 581,049 | 4/1897 | Unkenholz | 211/121 |
| 742,829 | 11/1903 | Brown | 312/304 X |
| 793,243 | 6/1905 | Symes | 211/121 |
| 818,595 | 4/1906 | Wilcox | 211/121 |
| 1,008,823 | 11/1911 | Hill | 312/9.4 |
| 1,909,942 | 5/1933 | Fingerman | 206/278 |
| 3,147,849 | 9/1964 | Scholfield et al. | 211/1.56 |
| 3,669,276 | 6/1972 | Woods | 211/34 |
| 4,133,589 | 1/1979 | Johns | 312/125 |
| 4,585,127 | 4/1986 | Benedict | 211/34 |
| 4,611,717 | 9/1986 | Hutson | 211/34 |
| 4,703,850 | 11/1987 | Walker | 206/293 |

*Primary Examiner*—Daniel P. Stodola
*Assistant Examiner*—Gregory J. Strimbu

[57] ABSTRACT

A shoe storage system for housing and organizing shoes. The system includes a compartment defined by a top wall, a bottom wall, a long open front, a long open back and long opposed side walls, and further includes a gear system disposed in the interior of the compartment, a pulley system coupled to the gear system, and a plurality of shoe pouches coupled to the gear system.

5 Claims, 3 Drawing Sheets

FIG 5
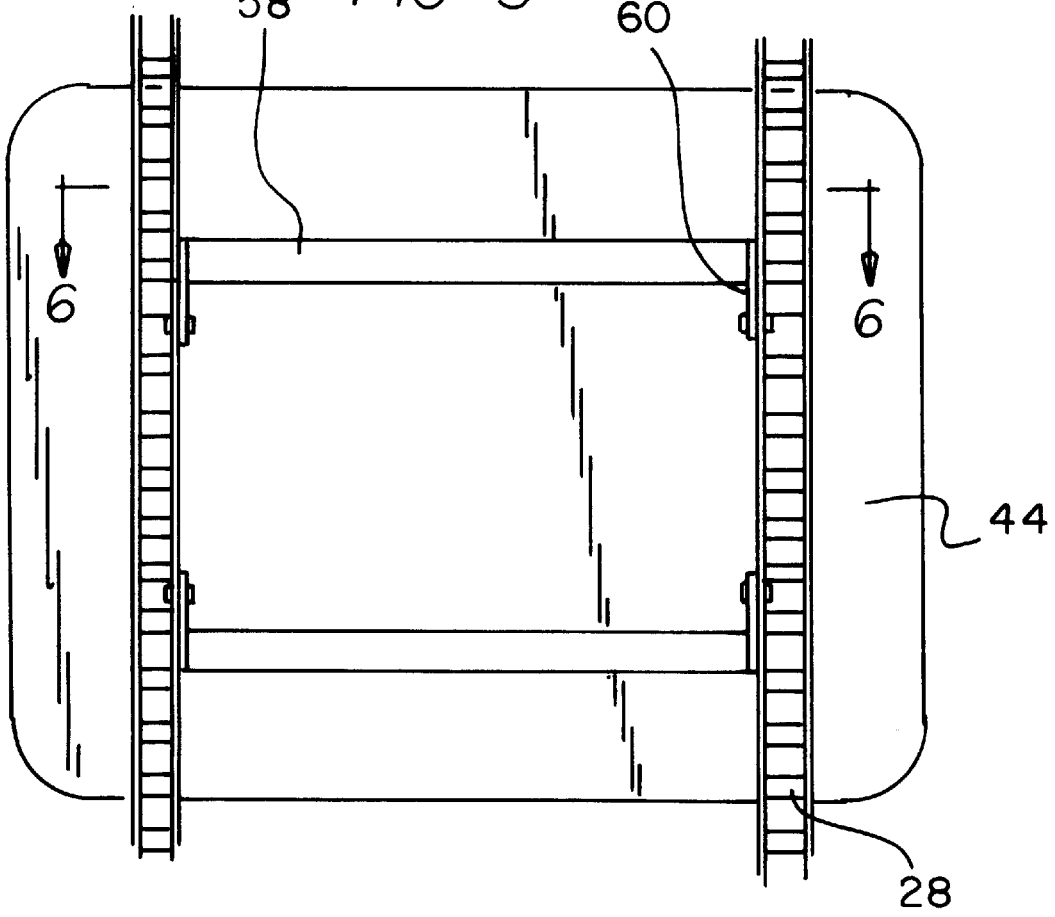
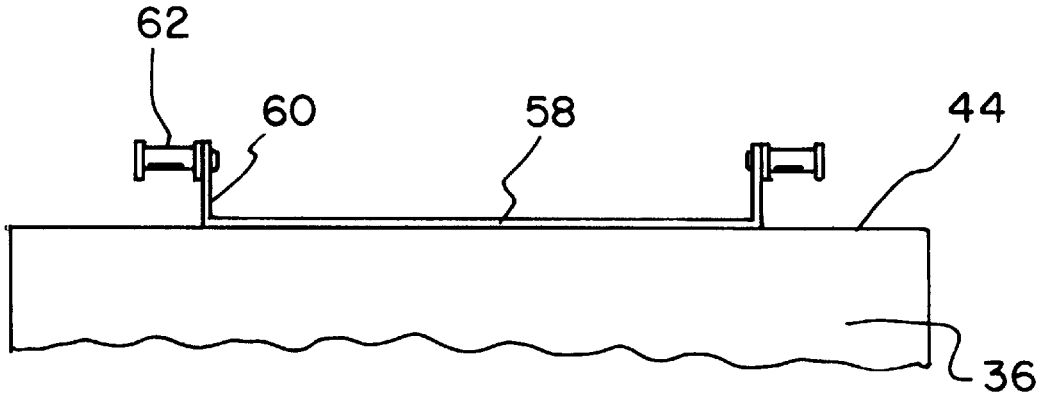
FIG 6

SHOE STORAGE SYSTEM WITH A COMPACT SHOE POUCH TRANSPORT MECHANISM

BACKGROUND OF THE INVENTION

1. Field of the Invention

The present invention relates to shoe organizers and more particularly pertains to a new shoe storage system for housing and organizing shoes.

2. Description of the Prior Art

The use of shoe organizers is known in the prior art. More specifically, shoe organizers heretofore devised and utilized are known to consist basically of familiar, expected and obvious structural configurations, notwithstanding the myriad of designs encompassed by the crowded prior art which have been developed for the fulfillment of countless objectives and requirements.

Known prior art shoe organizers include U.S. Pat. No. 4,008,807 to Phillips; U.S. Pat. No. 5,114,017 to Doyel; U.S. Pat. No. 5,076,442 to Hakeem; U.S. Pat. No. 4,585,127 to Benedict; U.S. Pat. No. 5,127,528 to Cone; and U.S. Pat. No. Des. 284,817 to Pryor.

While these devices fulfill their respective, particular objectives and requirements, the aforementioned patents do not disclose a new shoe storage system. The inventive device includes a compartment defined by a top wall, a bottom wall, a long open front, a long open back and long opposed side walls. A gear system is disposed interiorly of the compartment. A pulley system is coupled with respect to the gear system. A plurality of shoe pouches are coupled with respect to the gear system.

In these respects, the shoe storage system according to the present invention substantially departs from the conventional concepts and designs of the prior art, and in so doing provides an apparatus primarily developed for the purpose of housing and organizing shoes.

SUMMARY OF THE INVENTION

In view of the foregoing disadvantages inherent in the known types of shoe organizers now present in the prior art, the present invention provides a new shoe storage system construction wherein the same can be utilized for housing and organizing shoes.

The general purpose of the present invention, which will be described subsequently in greater detail, is to provide a new shoe storage system apparatus and method which has many of the advantages of the shoe organizers mentioned heretofore and many novel features that result in a new shoe storage system which is not anticipated, rendered obvious, suggested, or even implied by any of the prior art shoe organizers, either alone or in any combination thereof.

To attain this, the present invention generally comprises a compartment having a generally rectangular configuration. The compartment is defined by a top wall, a bottom wall, a long open front, a long open back and long opposed side walls. A gear system is disposed interiorly of the compartment. The gear system includes an upper rotating axle extending between the opposed side walls of the compartment disposed downwardly of the top wall and a lower rotating axle extending between the opposed side walls of the compartment disposed upwardly of the bottom wall of the compartment. The gear system includes a pair of upper chain gears coupled with the upper rotating axle in a spaced relationship and a pair of lower chain gears coupled with the lower rotating axle in a spaced relationship. A pair of chain loops extend between and around one upper chain gear and one lower chain gear and between and around another upper chain gear and another lower chain gear. A pulley system is coupled with respect to the gear system. The pulley system includes an upper pulley wheel coupled with the upper rotating axle of the gear system and a lower pulley wheel coupled with the lower rotating axle of the gear system. A drawstring extends around the upper and lower pulley wheels whereby pulling on the drawstring will facilitate rotation of the upper and lower rotating axles of the gear system. A plurality of shoe pouches are secured between the pair of chain loops of the gear system in a spaced relationship. Each of the shoe pouches comprises a top wall, a bottom, an openable front face, a rear face, and opposed side faces. The openable front face has a clear window disposed on an upper portion thereof and a grasping handle secured to a lower portion thereof. The rear face has a divider wall extending inwardly thereof thereby dividing the shoe pouch into an upper compartment and a lower compartment. The rear face has upper and lower brackets extending outwardly therefrom. The brackets each have angular outer free segments with chain couplers extending outwardly therefrom. The chain couplers engage the pair of chain loops of the gear system.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new shoe storage system apparatus and method which has many of the advantages of the shoe organizers mentioned heretofore and many novel features that result in a new shoe storage system which is not anticipated, rendered obvious, suggested, or even implied by any of the prior art shoe organizers, either alone or in any combination thereof.

It is another object of the present invention to provide a new shoe storage system which may be easily and efficiently manufactured and marketed.

It is a further object of the present invention to provide a new shoe storage system which is of a durable and reliable construction.

An even further object of the present invention is to provide a new shoe storage system which is susceptible of a low cost of manufacture with regard to both materials and labor, and which accordingly is then susceptible of low prices of sale to the consuming public, thereby making such shoe storage system economically available to the buying public.

Still yet another object of the present invention is to provide a new shoe storage system which provides in the apparatuses and methods of the prior art some of the advantages thereof, while simultaneously overcoming some of the disadvantages normally associated therewith.

Still another object of the present invention is to provide a new shoe storage system for housing and organizing shoes.

Yet another object of the present invention is to provide a new shoe storage system which includes a compartment defined by a top wall, a bottom wall, a long open front, a long open back and long opposed side walls. A gear system is disposed interiorly of the compartment. A pulley system is coupled with respect to the gear system. A plurality of shoe pouches are coupled with respect to the gear system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross-sectional view of the present invention as taken along line 5—5 of FIG. 3.

FIG. 6 is a cross-sectional view of the present invention as taken along line 6—6 of FIG. 5.

DESCRIPTION OF THE PREFERRED EMBODIMENT

Figure 1:
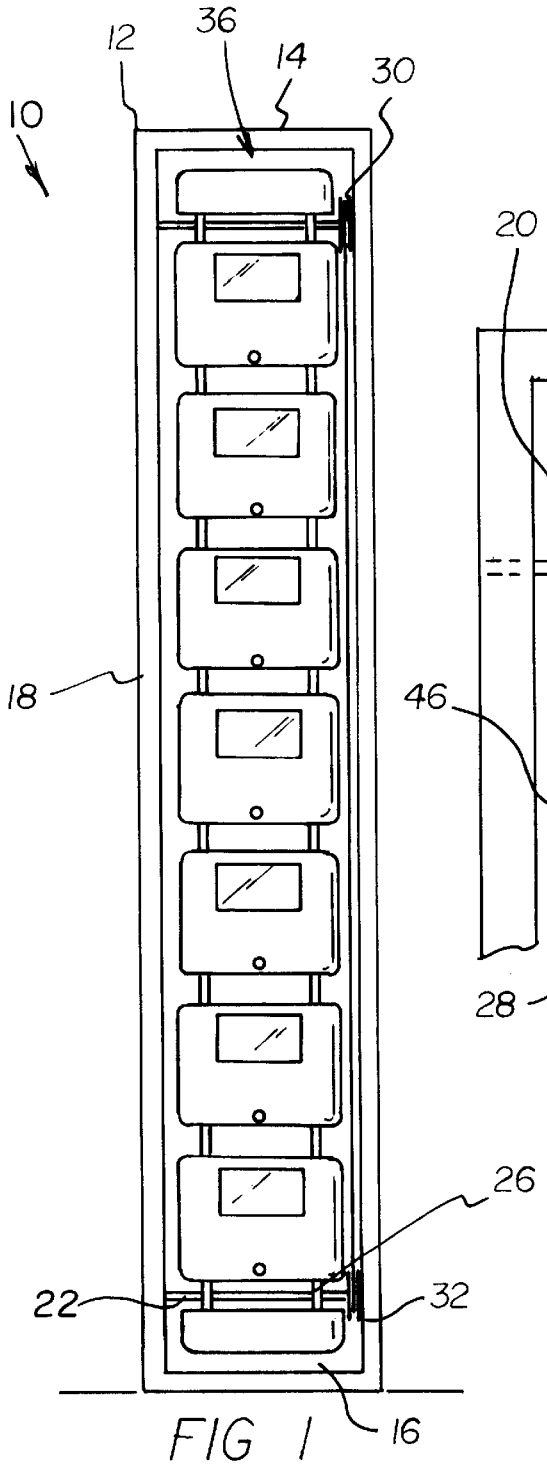
FIG. 1 is a front view of a new shoe storage system according to the present invention.
Figure 2:
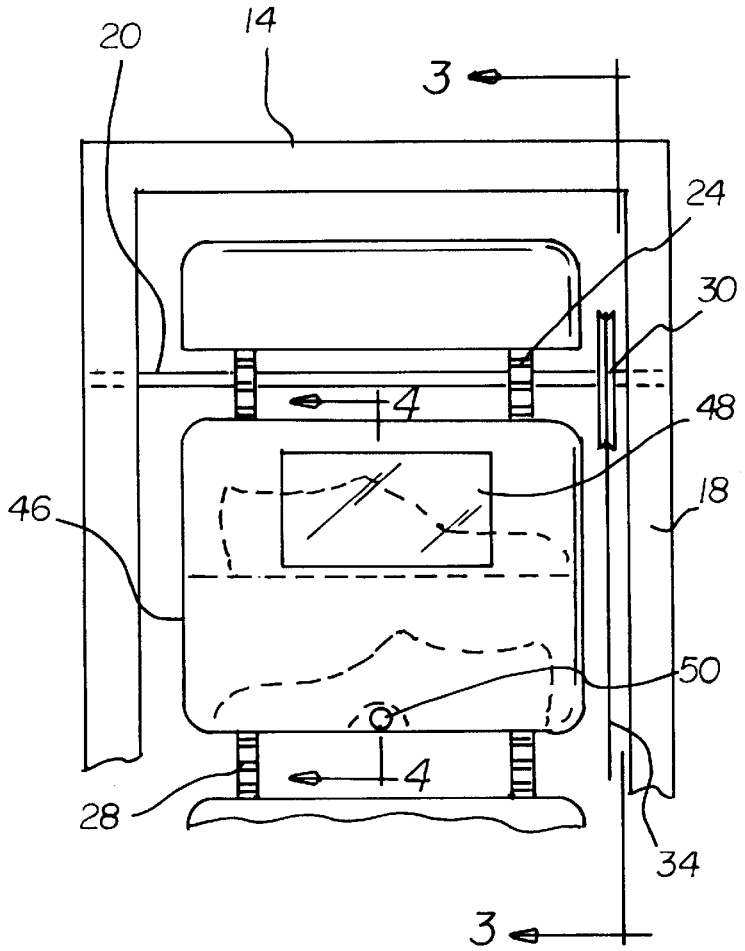
FIG. 2 is a front sectional view of the present invention.
Figure 3:
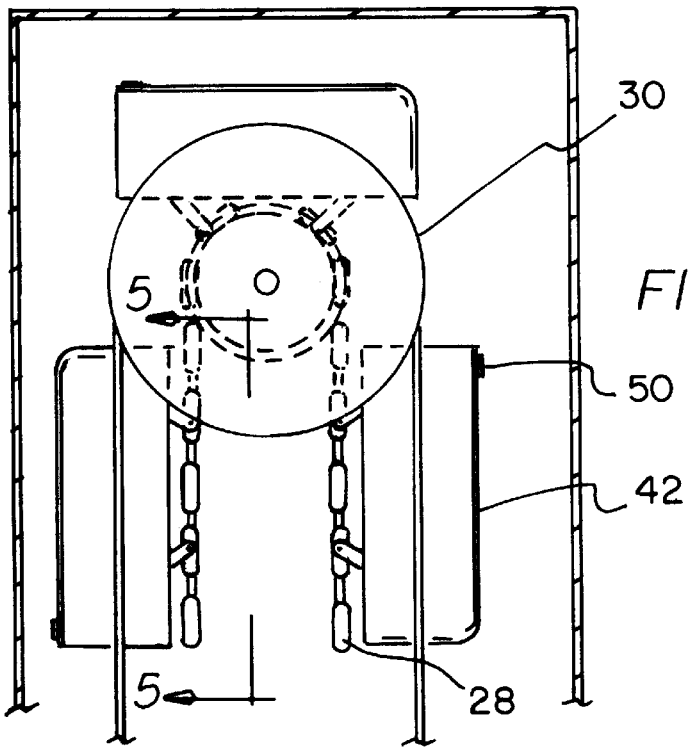
FIG. 3 is a cross-sectional view of the present invention as taken along line 3—3 of FIG. 2.
Figure 4:
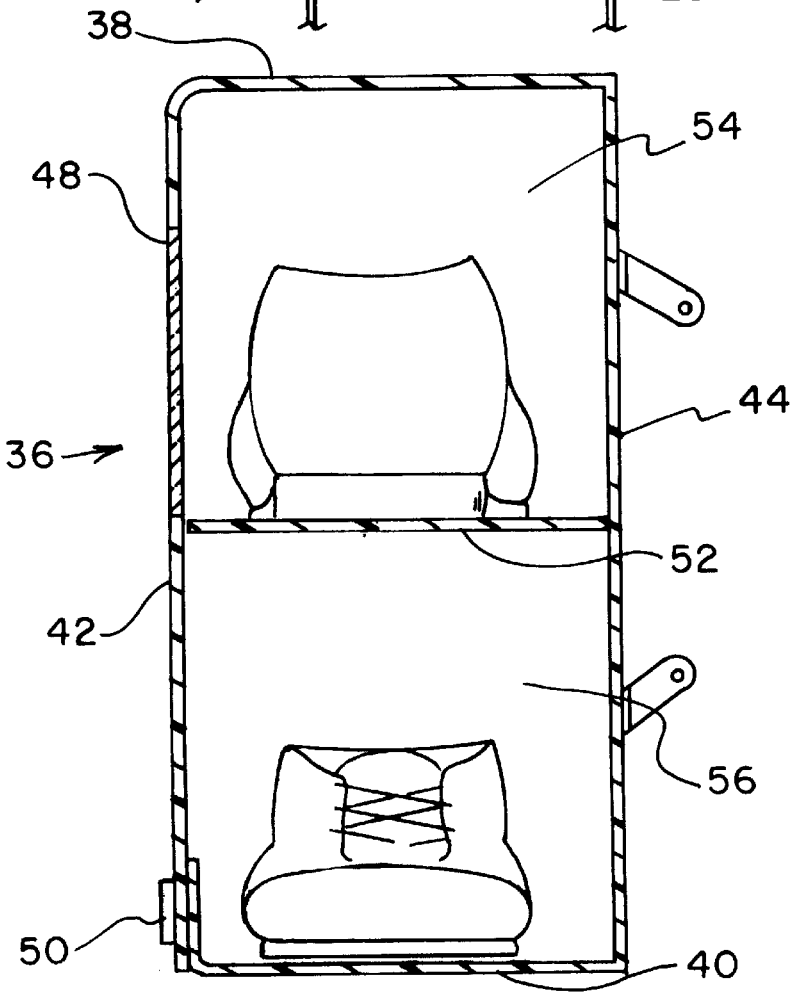
FIG. 4 is a cross-sectional view of the present invention as taken along line 4—4 of FIG. 2.

With reference now to the drawings, and in particular to FIGS. 1 through 6 thereof, a new shoe storage system embodying the principles and concepts of the present invention and generally designated by the reference numeral 10 will be described.

As best illustrated in FIGS. 1 through 6, the shoe storage system 10 comprises a compartment 12 having a generally rectangular configuration. The compartment is defined by a top wall 14, a bottom wall 16, a long open front, a long open back and long opposed side walls 18.

A gear system is disposed interiorly of the compartment 12. The gear system includes an upper rotating axle 20 extending between the opposed side walls 18 of the compartment 12 disposed downwardly of the top wall 14 and a lower rotating axle 22 extending between the opposed side walls 18 of the compartment 12 disposed upwardly of the bottom wall 16 of the compartment 12. The gear system includes a pair of upper chain gears 24 coupled with the upper rotating axle 20 in a spaced relationship and a pair of lower chain gears 26 coupled with the lower rotating axle 22 in a spaced relationship. A pair of chain loops 28 extend between and around one upper chain gear 24 and one lower chain gear 26 and between and around another upper chain gear 24 and another lower chain gear 26.

A pulley system is coupled with respect to the gear system. The pulley system includes an upper pulley wheel 30 coupled with the upper rotating axle 20 of the gear system and a lower pulley wheel 32 coupled with the lower rotating axle 22 of the gear system. A drawstring 34 extends around the upper and lower pulley wheels 30,32 whereby pulling on the drawstring 34 will facilitate rotation of the upper and lower rotating axles 20,22 of the gear system.

A plurality of shoe pouches 36 are secured between the pair of chain loops 28 of the gear system in a spaced relationship. Each of the shoe pouches 36 comprises a top wall 38, a bottom wall 40, an openable front face 42, a rear face 44, and opposed side faces 46. The openable front face 42 has a clear window 48 disposed on an upper portion thereof and a grasping handle 50 secured to a lower portion thereof. The front face 42 has rounded corners and edges for safety. The rear face 44 has a divider wall 52 extending inwardly thereof thereby dividing the shoe pouch 36 into an upper compartment 54 and a lower compartment 56. The side faces 46 of each of the shoe pouches 36 have a width defined between the front 42 and rear 44 faces of the associated shoe pouch and a length defined between the top 38 and bottom 40 walls of the associated shoe pouch. The width of each side face 46 is less than about ½ the length of the side face for reducing the amount of clearance space required for the shoe pouches to pass between the axles and the top and bottom walls of the compartment. The rear face 44 has upper and lower brackets 58 extending outwardly therefrom. The brackets 58 each have angular outer free segments 60 with chain couplers 62 extending outwardly therefrom. The chain couplers 62 engage the pair of chain loops 28 of the gear system. The chain couplers 62 engage the pair of chain loops of the gear system in a manner such that each of the shoe pouches is nonrotatably coupled to the chain loops. The gear system is thus housed in the compartment between planes which are spaced apart by a distance equal to a width of one of the front faces, a relationship which reduces the width required within in the conmpartment for accommodating the gear system.

In use, a person would fill each of the shoe pouches 36 with their shoes, with one shoe in the upper compartment 54 and the other shoe in the lower compartment 56. This is facilitated through the openable front face 42. The user simply pulls on the drawstring 34 to rotate the shoe pouches 36 around the compartment 12 to visualize each pair of shoes within the shoe pouches 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoe storage system for housing and organizing shoes comprising, in combination:

a compartment having a generally rectangular configuration and defining a compartment interior, the compartment being defined by a top wall, a bottom wall, and elongate opposed side walls extending between the top and bottom walls, a front opening being defined between front edges of the side walls, a back opening being defined between rear edges of the side walls;

a gear system disposed in the compartment interior, the gear system including an upper rotating axle extending between the opposed side walls of the compartment and disposed downwardly from the top wall, and a lower rotating axle extenting between the opposed side walls of the compartment and disposed upwardly from the bottom wall of the compartment, the gear system including a pair of upper chain gears coupled with the upper rotating axle, the pair of upper chain gears being arranged in a spaced relationship with respect to each other, and the gear system including a pair of lower chain gears coupled with the lower rotating axle, the pair of lower chain gears being arranged in a spaced relationship with respect to each other, a pair of chain loops extending between and around the upper chain gears and the lower chain gears;

a pulley system coupled to the gear system, the pulley system including an upper pulley wheel coupled with the upper rotating axle of the gear system and a lower pulley wheel coupled with the lower rotating axle of the gear system, a drawstring extending around the upper and lower pulley wheels whereby pulling on the drawstring will facilitate rotation of the upper and lower rotating axles of the gear system;

a plurality of shoe pouches mounted to the pair of chain loops of the gear system, each of said shoe pouches being disposed in a spaced relationship with respect to an adjacent one of said pouches, each of the shoe pouches comprising a pouch interior bounded by a top wall, a bottom, an openable front face, a rear face, and opposed side faces, each said openable front face having a clear window disposed on an upper portion of the front face and a grasping handle secured to a lower portion of the front face, each said rear face having a divider wall extending inwardly into the pouch interior of a respective one of the shoe pouches thereby dividing the interior of the respective one of the shoe pouches into an upper compartment and a lower compartment, each said rear face having upper and lower brackets extending outwardly therefrom, each said bracket having angular outer free segments, each said outer free segment including a chain coupler extending outwardly therefrom, the chain couplers engaging the pair of chain loops of the gear system such that each of the shoe pouches is nonrotatably coupled to pair of chain loops;

the gear system being housed between substantially vertical planes which are spaced apart by a distance equal to a width of one of said front faces for reducing a horizontal width dimension of the gear system in the compartment interior;

each said side face having a width equal to a distance defined between the front and rear faces of the respective one of the shoe pouches and a length equal to a distance defined between the top wall and bottom of the respective one of the shoe pouches wherein the width of each said side face is less than about one half the length of each said side face for reducing a clearance space between the upper rotating axle and the top wall of the compartment and a clearance space between the lower rotating axle and the bottom wall of the compartment; and each of the front faces having rounded corners and edges for safety.

2. A shoe storage system for housing and organizing shoes comprising, in combination:

a compartment having a compartment interior defined by a top wall, a bottom wall, and elongate opposed side walls extending between the top and bottom walls, a front opening being defined between front edges of the side walls, a back opening being defined between rear edges of the side walls;

a gear system disposed in the compartment interior;

a pulley system coupled to the gear system; and a plurality of shoe pouches nonrotatably coupled to the gear system, each of the shoe pouches comprises a pouch interior bounded by a top wall, a bottom, an openable front face, a rear face, and opposed side faces, each said side face has a width equal to a distance defined between the front and rear faces of a respective one of said shoe pouches and a length equal to a distance defined between the top wall and bottom of the respective one of the shoe pouches, wherein the width of each said side face is less than about one half the length of each said side face;

the gear system being housed between substantially vertical planes; which are spaced apart by a distance equal to a width of one of said front faces;

each of the openable front faces has a clear window disposed on an upper portion thereof and a grasping handle secured to a lower portion thereof; and each said rear face has a divider wall extending into the pouch interior of the respective one of the shoe pouches thereby dividing the pouch interior of the respective one of the shoe pouches into an upper compartment and a lower compartment.

3. The shoe storage system as set forth in claim 2 wherein the gear system includes an upper rotating axle extending between the opposed side walls of the compartment and disposed downwardly from the top wall, and a lower rotating axle extending between the opposed side walls of the compartment and disposed upwardly from the bottom wall of the compartment, the gear system includes a pair of upper chain gears coupled with the upper rotating axle, the pair of upper chain gears being arranged in a spaced relationship with respect to each other, the gear system includes a pair of lower chain gears coupled with the lower rotating axle, the pair of lower chain gears being arranged in a spaced relationship with respect to each other, a pair of chain loops extending between and around the upper chain gears and the lower chain gears.

4. The shoe storage system as set forth in claim 2 wherein the pulley system includes an upper pulley wheel coupled to the gear system and a lower pulley wheel coupled to the gear system, a drawstring extending around the upper and lower pulley wheels whereby pulling on the drawstring will facilitate rotation of the gear system.

5. The shoe storage system as set forth in claim 2 wherein each said rear face has upper and lower brackets extending outwardly therefrom, each said bracket having angular outer free segments, each said outer free segment including a chain coupler extending outwardly therefrom, the chain couplers engaging the gear system.

* * * * *